US010964294B2

(12) United States Patent
Peters

(10) Patent No.: US 10,964,294 B2
(45) Date of Patent: Mar. 30, 2021

(54) DEVICE FOR AIDING IN STRINGING MUSICAL INSTRUMENTS

(71) Applicant: Mark Alan Peters, Venice, FL (US)

(72) Inventor: Mark Alan Peters, Venice, FL (US)

(73) Assignee: Mark Alan Peters, Venice, FL (US)

( * ) Notice: Subject to any disclaimer, the term of this patent is extended or adjusted under 35 U.S.C. 154(b) by 0 days.

(21) Appl. No.: 16/823,321

(22) Filed: Mar. 18, 2020

(65) Prior Publication Data

US 2020/0312283 A1 Oct. 1, 2020

Related U.S. Application Data

(60) Provisional application No. 62/820,790, filed on Mar. 19, 2019.

(51) Int. Cl.
*G10D 3/12* (2020.01)

(52) U.S. Cl.
CPC ..... *G10D 3/12* (2013.01)

(58) Field of Classification Search
CPC ..... G10D 3/12
See application file for complete search history.

(56) References Cited

U.S. PATENT DOCUMENTS 4,197,780 A * 4/1980 Smith ..... G10D 3/00 84/453
4,278,002 A * 7/1981 Siminoff ..... G10D 3/20 84/304
4,505,177 A * 3/1985 Schaller ..... G10D 3/00 84/329
6,255,575 B1 * 7/2001 Pearse ..... G10D 3/10 84/312 R
6,563,037 B2 * 5/2003 Hamilton ..... G10D 3/00 84/484
7,301,089 B1 * 11/2007 Liao ..... G10D 3/20 84/453
7,906,715 B2 * 3/2011 Coco ..... G10D 3/00 84/307
8,766,069 B2 * 7/2014 Bisheimer ..... G10D 3/14 84/297 R
9,076,412 B1 * 7/2015 Rolling ..... G10D 1/085
9,892,718 B2 * 2/2018 Lambert ..... G10D 3/20
10,325,575 B1 * 6/2019 Barker ..... G10D 1/08
10,522,118 B1 * 12/2019 Jones ..... G10D 3/20
2002/0038596 A1 * 4/2002 Lome ..... G10D 3/10 84/458
2020/0312283 A1 * 10/2020 Peters ..... G10D 3/20

* cited by examiner

*Primary Examiner* — Robert W Horn

(57) ABSTRACT

Disclosed herein is an apparatus for aiding in mounting strings to an instrument, which includes a frame having: a pair of opposing extension members, a cross-member connecting the opposing extension members at a distal end; and a support member extending laterally from each of the opposing extension members. The apparatus also includes a retention assembly and a tensile retaining mechanism supported about the cross-member and extending toward the neck portion of the musical instrument. The tensile retaining mechanism including clip member wherein the clip member of the tensile retaining mechanism is configured to receive a string for mounting to the instrument, the tensile retaining mechanism configured to maintain a desired lateral position along the neck portion and maintain a tensile force to the string during a tightening process.

1 Claim, 9 Drawing Sheets

DEVICE FOR AIDING IN STRINGING MUSICAL INSTRUMENTS

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

FIELD OF THE INVENTION

The present invention relates generally string instruments, and particularly to mounting or re-mounting the strings thereof.

BACKGROUND

It has been recognized that the process of mounting strings on a musical instrument often requires the user to be mindful of a plurality of factors including a proper amount of initial tension, placement, and an initial number of windings around associated tuning pegs or posts which can be difficult to manage while utilizing only two hands, particularly when initially affixing a string to an associated neck or fretboard of an associated instrument, etc.

The invention described herein provides a solution that seeks to solve the above identified problems, and thus, aids in retaining strings with proper initial tension and number of windings around a tuning peg thereon.

SUMMARY

It has been recognized that various deficiencies as recognized in current manual methods for mounting strings on an instrument can be overcome by providing a device being configured to mount on the neck or fretboard of an associated instrument, the device having a frame and tensile retaining mechanism supported by the frame. As such, a string for mounting on the instrument can be anchored into the base of the instrument, extended through the tensile retaining mechanism supported by the frame, and then threaded through a tuning peg. The device can then maintain a proper initial tension, and relative position on the fretboard or neck such that the user can use both hands for manipulating the new string through the tuning peg and properly manipulate the string around the tuning peg while simultaneously tightening the tuning peg to obtain a proper number of initial windings with a proper overlap etc. so as to maintain proper windings for future tuning of the strings of the instrument.

DETAILED DESCRIPTION

Figure 1:
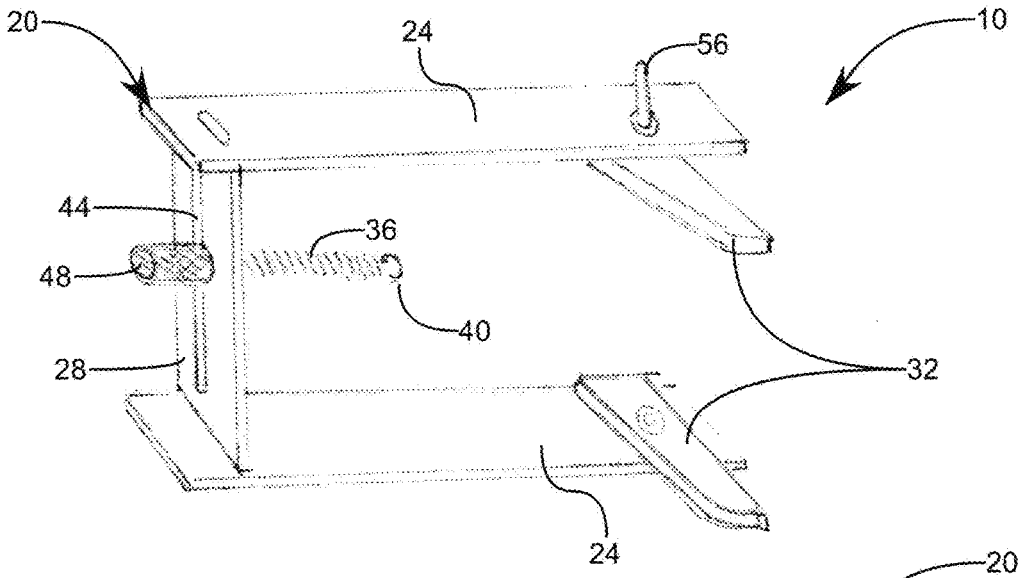
FIG. 1 illustrates a perspective view of a device for aiding in stringing musical instruments being illustrative of various aspects of the present invention.
Figure 2:
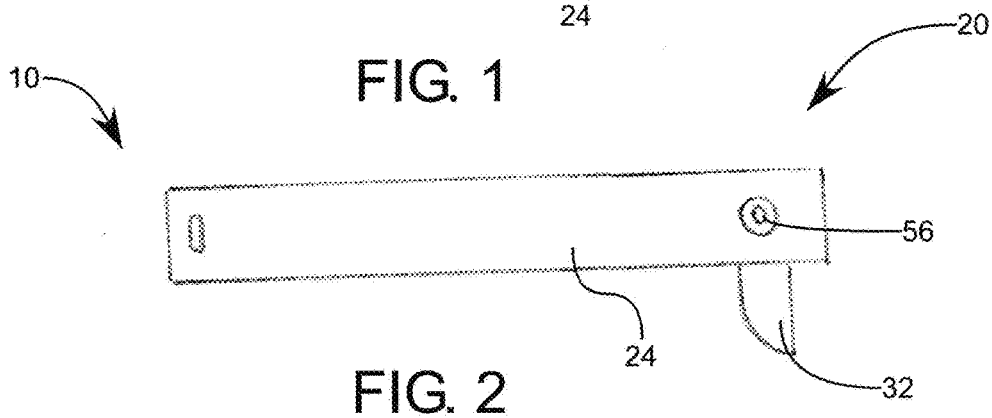
FIG. 2 illustrates a side view of the device for aiding in stringing musical instruments of FIG. 1.
Figure 3:
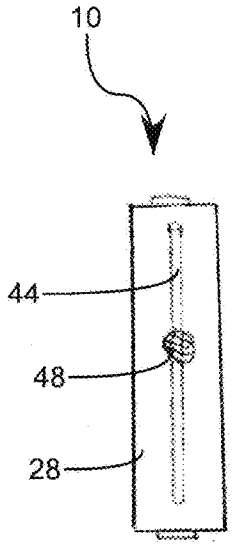
FIG. 3 illustrates atop view of the device for aiding in stringing musical instruments of FIG. 1.
Figure 4:
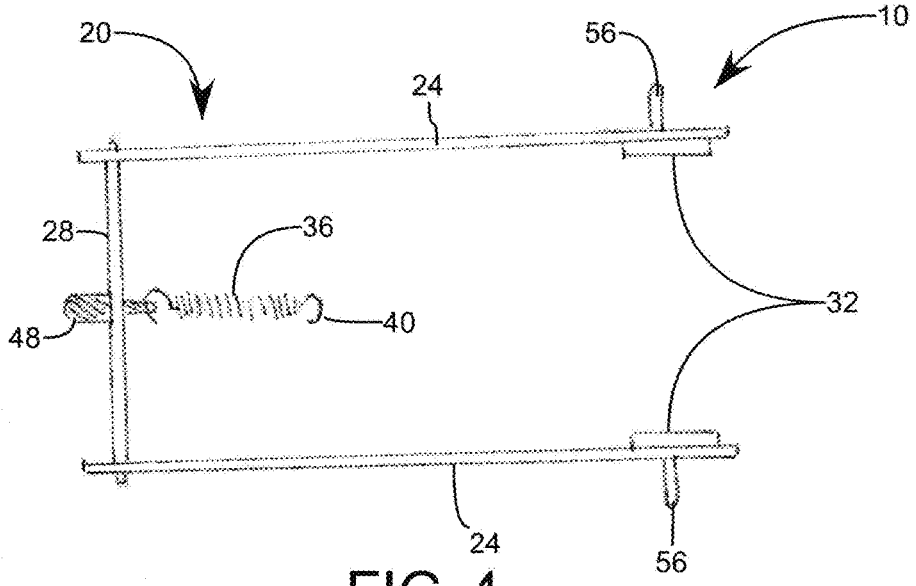
FIG. 4 illustrates afront view of the device for aiding in stringing musical instruments of FIG. 1.
Figure 5:
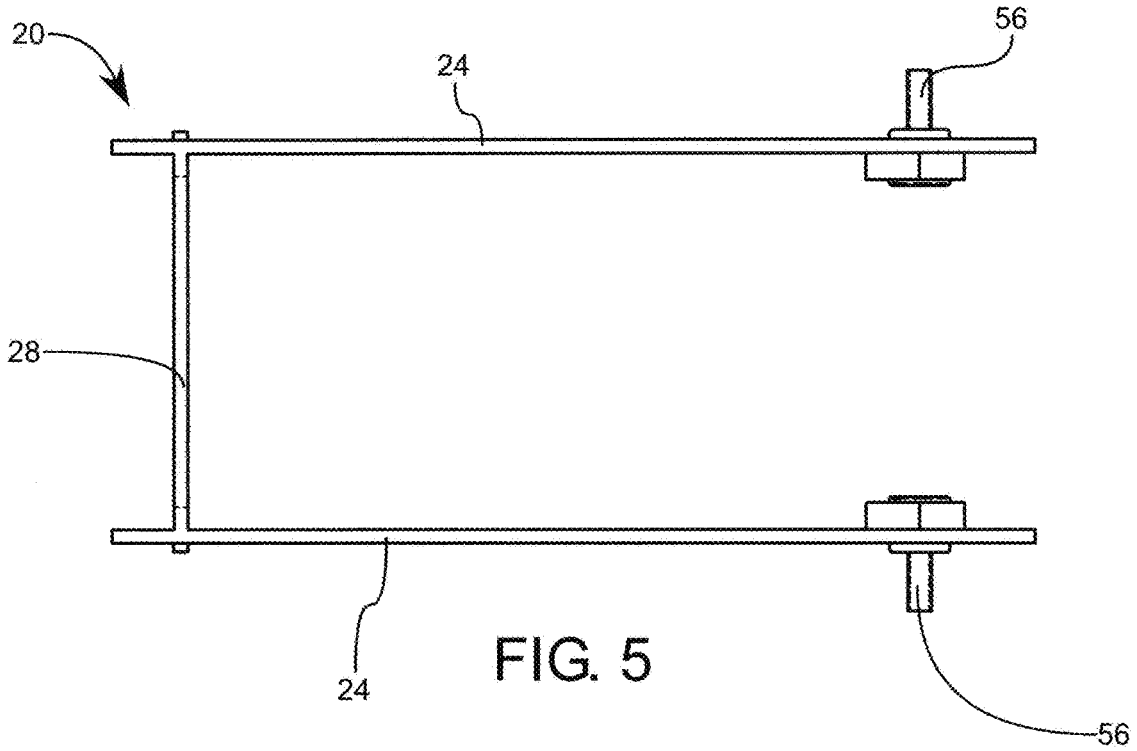
FIG. 5 illustrates afront view of a frame portion of the device for aiding in stringing musical instruments of FIG. 1.
Figure 6:
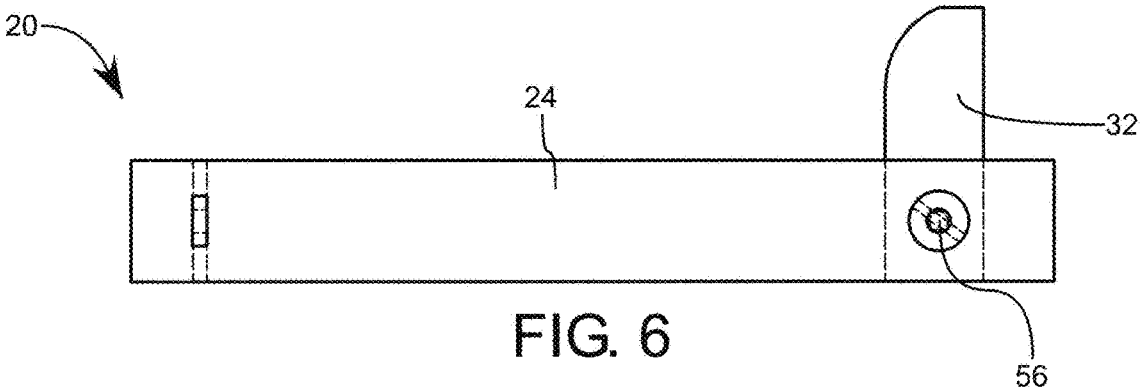
FIG. 6 illustrates aside view of the frame portion of the device for aiding in stringing musical instruments of FIG. 5.
Figure 7:
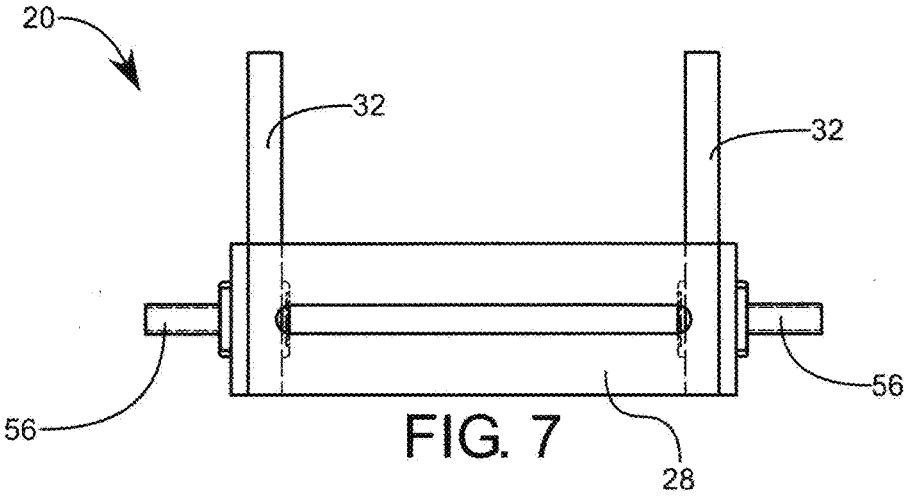
FIG. 7 illustrates atop view of the frame portion of the device for aiding in stringing musical instruments of FIG. 5.
Figure 8:
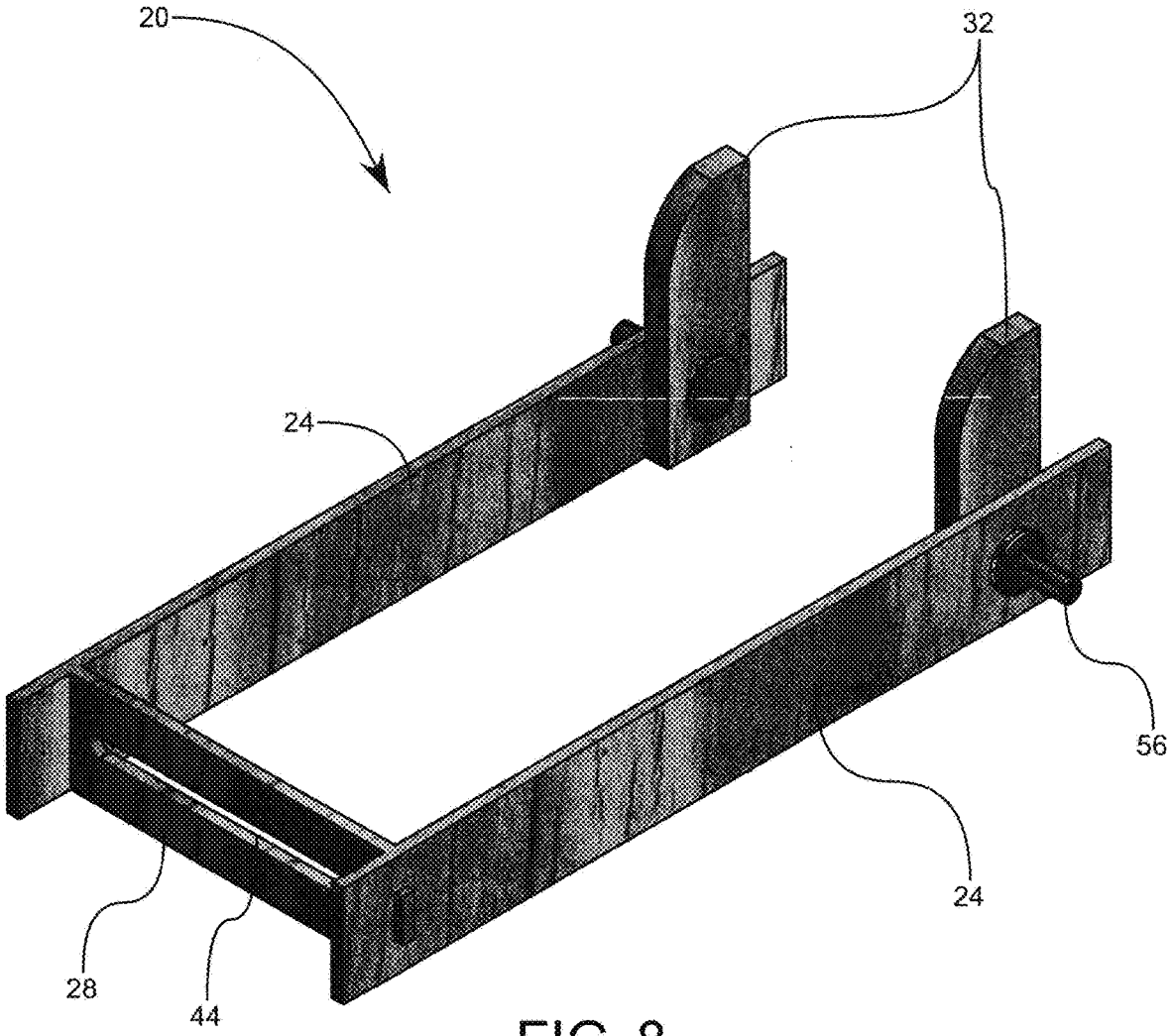
FIG. 8 illustrates a perspective view of the frame portion of the device for aiding in stringing musical instruments of FIG. 5.
Figure 9:
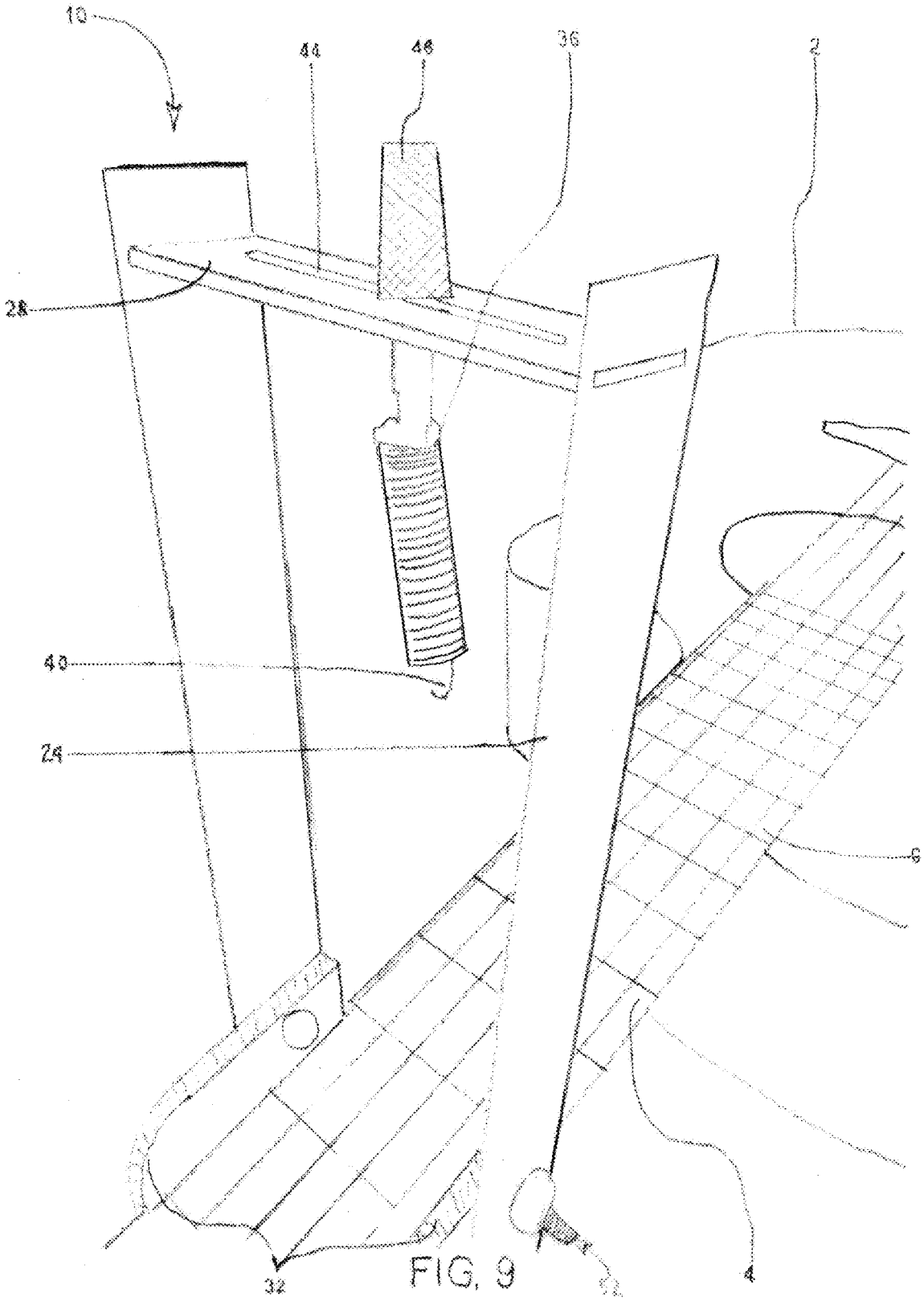
FIG. 9 illustrates afront perspective view of the device for aiding in stringing musical instruments of FIG. 1 as mounted on an exemplary string instrument.
Figure 10:
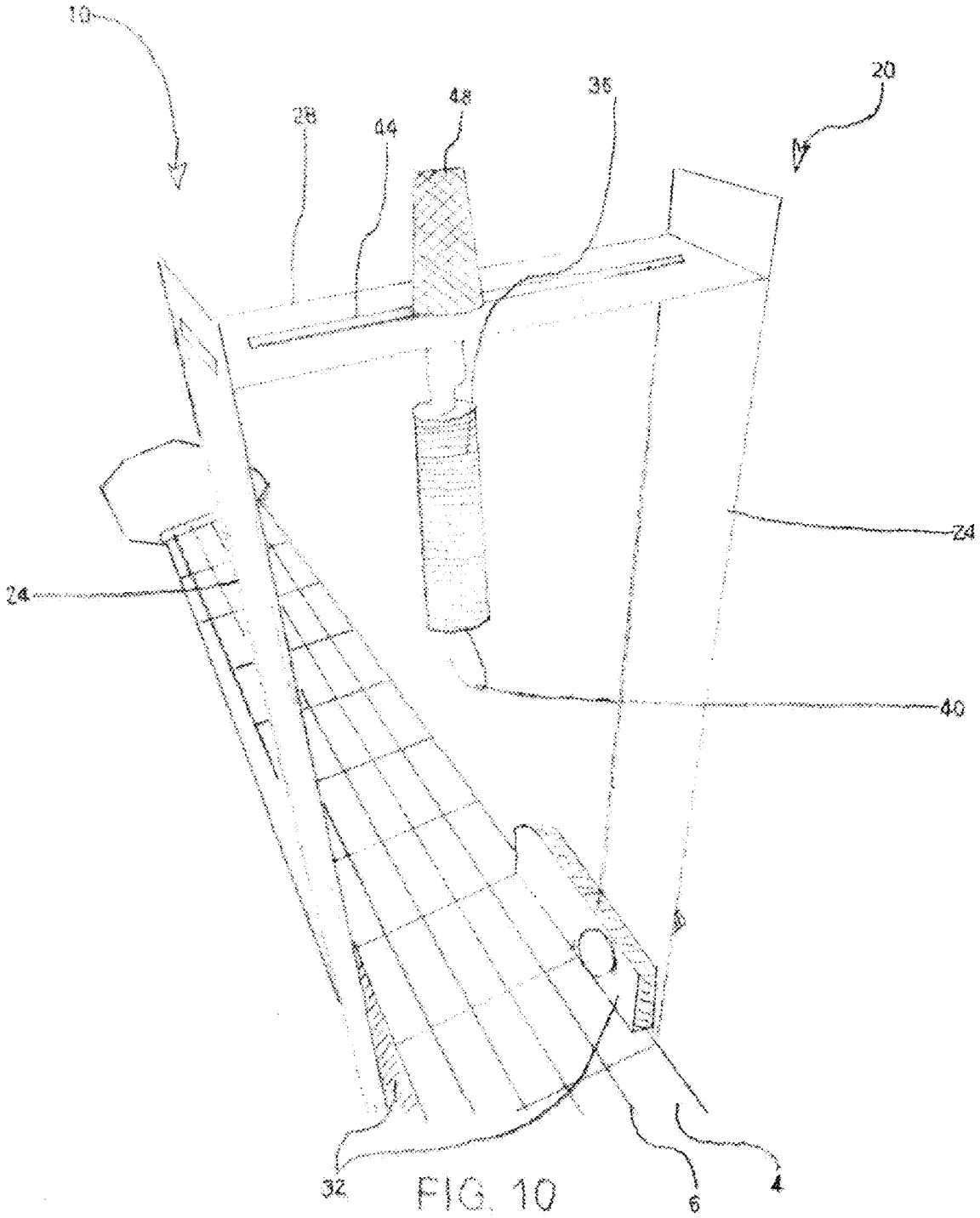
FIG. 10 illustrates an alternative rear perspective view of the device for aiding in stringing musical instruments of FIG. 1 as mounted on an exemplary string instrument.
Figure 11:
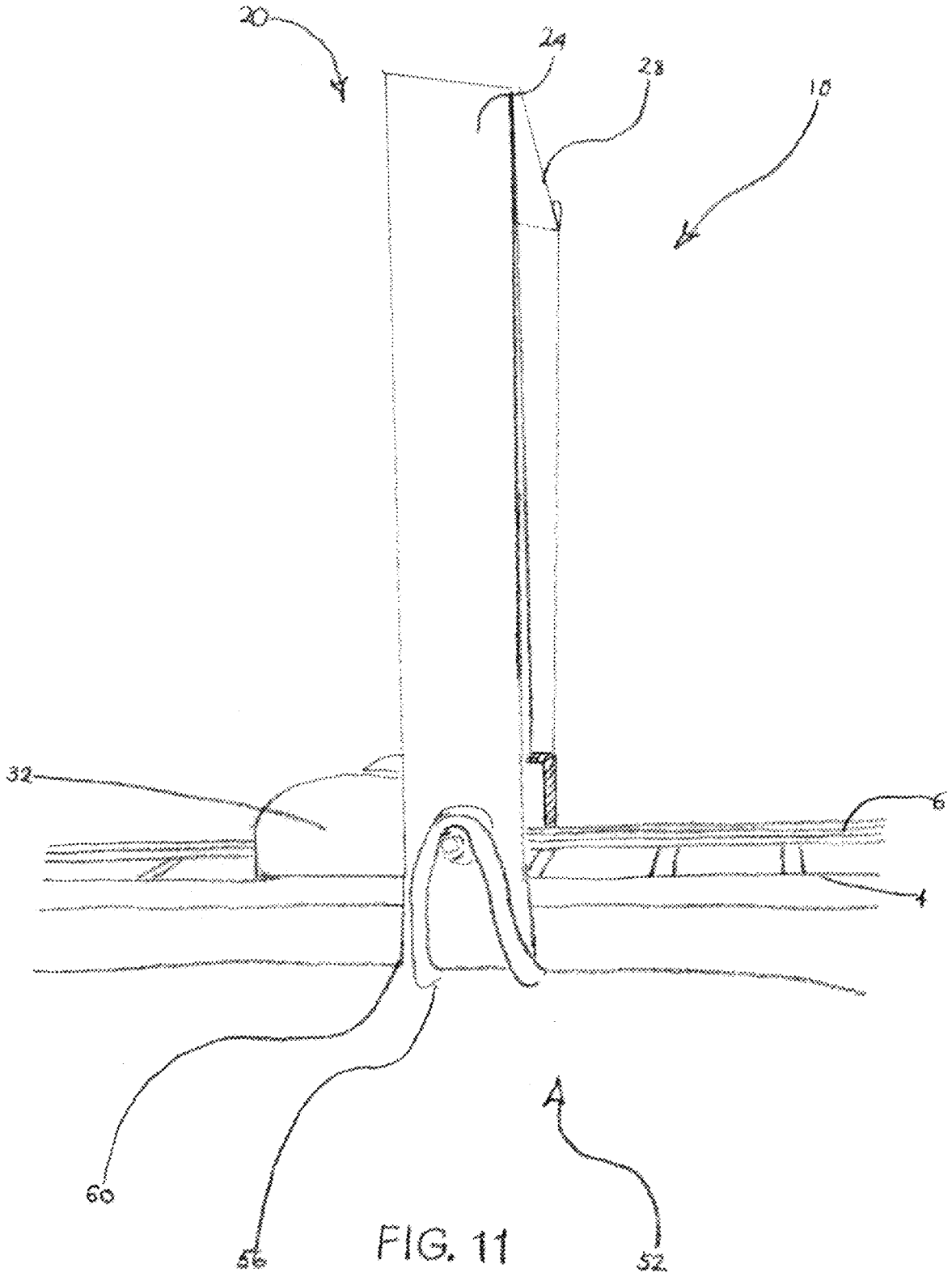
FIG. 11 illustrates an alternative side perspective view of the device for aiding in stringing musical instruments of FIG. 1 as mounted on an exemplary string instrument.
Figure 12:
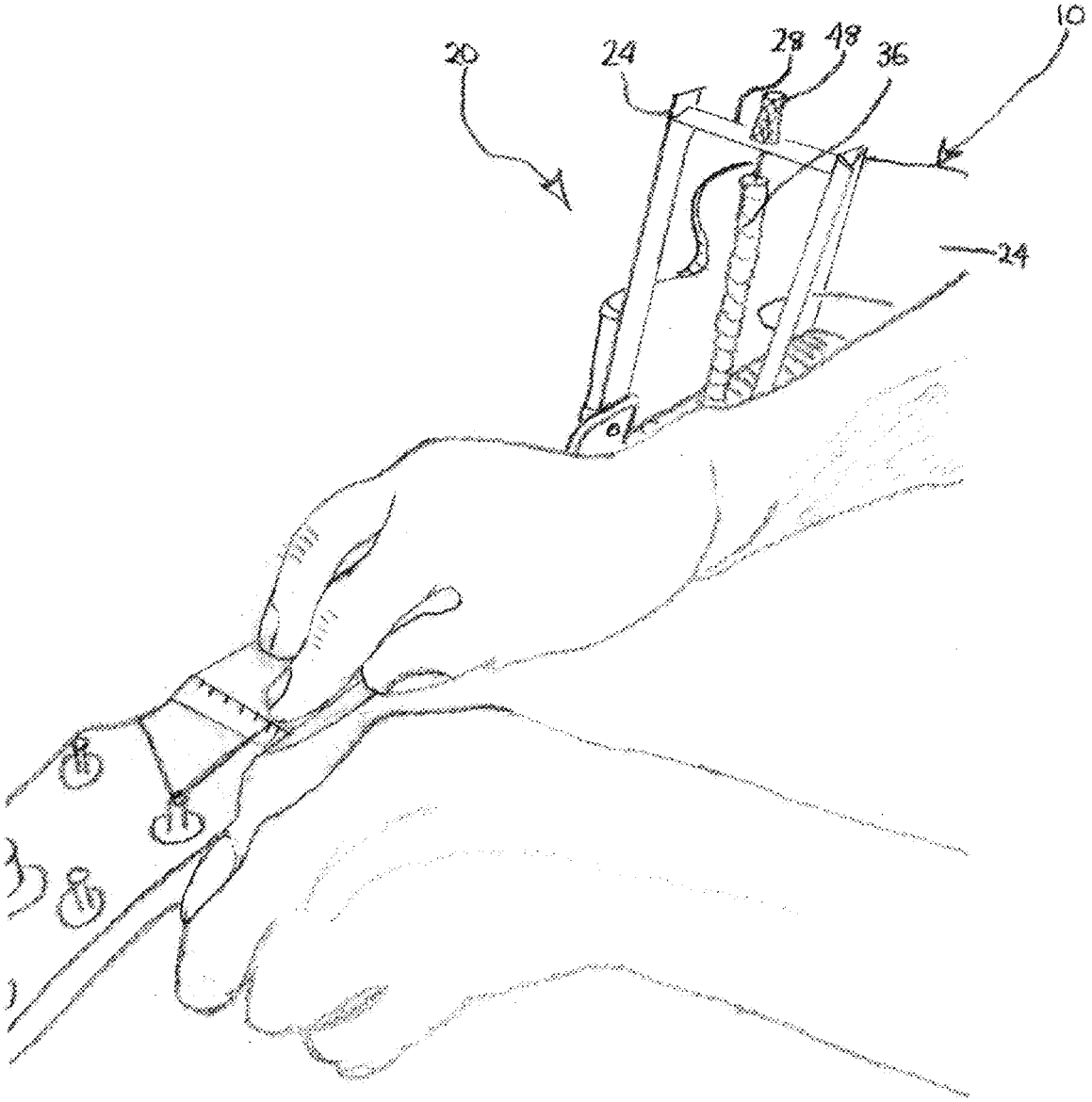
FIG. 12 illustrates an alternative side perspective view of the device for aiding in stringing musical instruments of FIG. 1 as mounted on an exemplary string instrument having a new string retained by the tensile retention mechanism.
Figure 13:
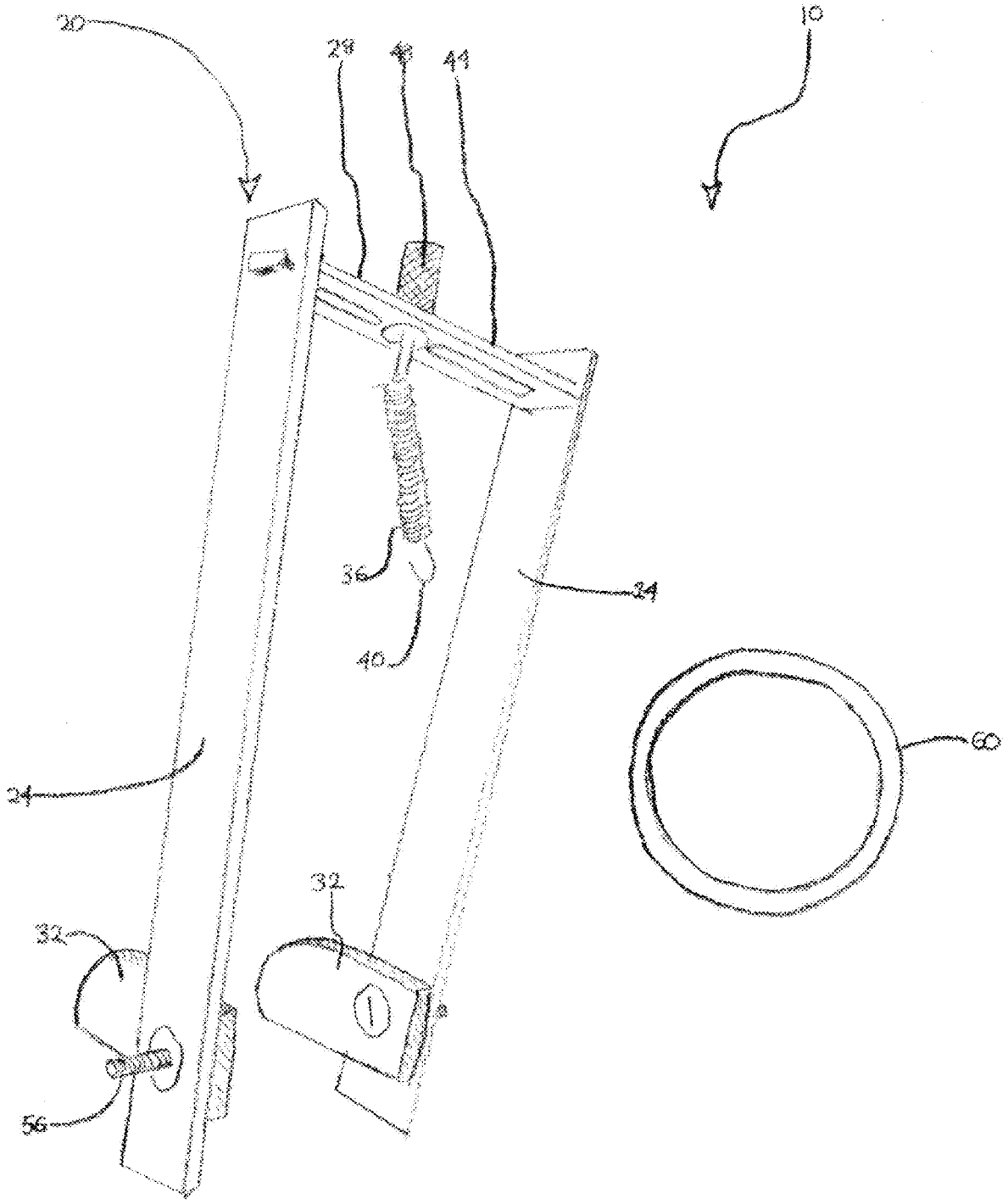
FIG. 13 illustrates an alternative front disassembled perspective view of the device for aiding in stringing musical instruments of FIGS. 1.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "horizontal" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

As discussed above, it has been recognized that various deficiencies and difficulties of manual stringing methods can be overcome by utilizing a device for aiding in stringing musical instruments 10 as contemplated herein, the device relating to an assembly being configured to mount on the neck or fretboard of an associated instrument, the assembly having a frame and a tensile retaining mechanism supported by the frame configured to retain a string being mounted onto the instrument in a particular position and under a certain amount of tension.

As discussed briefly above, and as particularly illustrated in FIGS. 1-4 and 9-14, a device 10 is contemplated herein having a frame 20 which is configured to be attached to a neck or fretboard 4 of a string instrument 2. The frame 20 is illustrated in greater detail in FIGS. 5-8.

It will be understood that while the present disclosure is discussed in relation to a guitar serving as the string instrument, however, the device 10 can be similarly utilized for stringing any string instrument, including alternative classical instruments such as a violin, cello, base, or any other string instrument as will be understood by those having skill in the art of musical instruments and the maintenance and tuning thereof.

The frame 20 can include a pair of extension members 24 configured to be anchored to the fretboard 4 about a base portion and terminating in distal ends. A cross-member 28 can be provided about the distal ends of the extension members 24. In some embodiments the extension members can include one or more stabilizers or supports 32 which can extend laterally about the base portion of the extension members 24 and extend along the fretboard 4 or neck so as to prevent tipping of the frame 20 while retaining an instrument string 6 during a stringing operation.

The cross-member 28 can then be provided with a tensile retaining mechanism 36 being suspended above the fretboard 4, the tensile retaining mechanism 36 including a hook or clip member 40 about a distal end thereof which is designed to retain a loose string 6 during the stringing process. The tensile retaining mechanism 36 can be configured to be adjustable along the width of the cross-member 28 so as to allow for proper positioning directly above a desired string position about the neck or fretboard 4.

In some embodiments the tensile retaining mechanism 36 can be provided at a fixed point about the cross-member 28 of frame, and in some embodiments the tensile retaining mechanism can be configured to slide laterally about the frame so as to provide a desired positioning and tensile force between the instrument/frame, and the strings being suspended thereby. In the sliding configuration, the tensile retaining mechanism 36 can be provided with a tightening means, such as a pin lock, threaded portion, or some other mechanism which can then secure the tensile retaining mechanism in a desired location.

In the embodiment illustrated herein the cross-member 28 can include a channel 44 wherein the tensile retaining mechanism 36 can be provided with a locking mechanism 48. The locking mechanism can include a threaded post and nut wherein the post extends through the channel and the nut can be loosened or tightened so as to lock or unlock a relative position of the tensile retaining mechanism. It will be appreciated that alternative mechanisms can provide an alternative friction lock of the tensile retaining mechanism 36 about the cross-member 28, such devices may include spring clips or spring-loaded nuts which instead rely on a spring and friction rather than a threaded mechanism for adjusting a required compressive locking force along the length of the channel 44 or along an edge of the cross-member 36.

It is also understood that while the tensile retaining mechanism 36 is herein illustrated as including a spring to provide the tensile force for purposes of illustration only, and that elastic bands, air-cylinders, or any other suitable means of providing a desired tensile force are also contemplated herein.

In order to affix the device 10 to the neck or fretboard 4 of the instrument 2, the device 10 can also be provided with a retention assembly 52, which can include an attachment interface 56 and an attachment member 60. As illustrated herein the attachment interface 56 is illustrated as a post which can receive an attachment member 60 illustrated herein as an elastic member. It will be understood that this assembly is intended to provide a compressive force between the extension members 24 as well as the stabilizers or supports 32 and the fretboard 4. This arrangement is being provided for illustrative purposes only and, as has been recognized, the attachment interface could instead be replaced with apertures or slots, and the attachment member 60 could be provided as a strap which could be manually tightened and held firm using a ratcheting mechanism, buttons, hook-and-loop connection provided to the surfaces of the straps themselves, etc.

It will be appreciated that while the supports 32 are illustrated as extending perpendicular from the extension members 24 in only a single direction, that the supports 32 can be configured to extend in both directions or opposing directions on each side of the device 10.

Additionally, in some embodiments, and as illustrated herein, the cross-member 36, extension members 24, and supports 32 can be formed separately and coupled to one another utilizing separable means such that the device 10 can be disassembled and stored in a compact state. In yet additional embodiments the various components can be provided with hinged connections which allow for rotation or pivoting with respect to one another so as to allow for a collapsing of the device 10 for storage. In yet additional embodiments, each of the components can be formed unitarily with solid or rigid connections which would increase the strength and reduce flexing during use.

In use, a string 6 for mounting on the instrument 2 can be anchored into the base of the instrument such as into a bridge or a bridge saddle. The string 6 can then be extended through hook or clip member 40 being provided about the distal end of the tensile retaining mechanism 36 supported by the frame 20. The end of the string 6 can then threaded through a tuning peg provided about an end of the neck 4. The length of the retaining mechanism 36 can be selected so as to place the clip member 40 an optimal distance from the neck 4 such that as the tuning peg is rotated to cause a winding of the string about the peg there is sufficient length on the string 6 so as to allow the winding to overlap and provide an effective anchor or tie of the string 6 bout the tuning and that no slipping of the string 6 around the peg occurs.

Then as the winding is continued the tensile retaining mechanism 36 will extend while maintaining tension on the string 6 so as to ensure the string is maintained within a desired notch or channel on the bridge, about the neck, etc.

In some instances, a particular tensile retaining mechanism 36 can be selected having a particular spring constant corresponding to a particular string size, length, instrument application, etc.

In yet additional embodiments, a tensile retaining mechanism 36 can be selected having a particular length, such that when drawn toward the fretboard or neck 6 during a winding process, the distance traveled by the string allows for a proper number of windings around the tuning or retention peg at the end of the instrument.

In yet additional embodiments, varying frames can be selected having extension member 24 of varying length so as to provide an optimal distance of the tensile retaining mechanism 36 above the fretboard or neck 4. The device can then maintain a proper initial tension, and relative position on the fretboard or neck such that the user can use both hands for manipulating the new string through the tuning peg and properly manipulate the string around the tuning peg while simultaneously tightening the tuning peg to obtain a proper number of initial windings with a proper string tip or winding overlap etc., so as to maintain proper windings for future tuning of the strings of the instrument.

Figure 14:
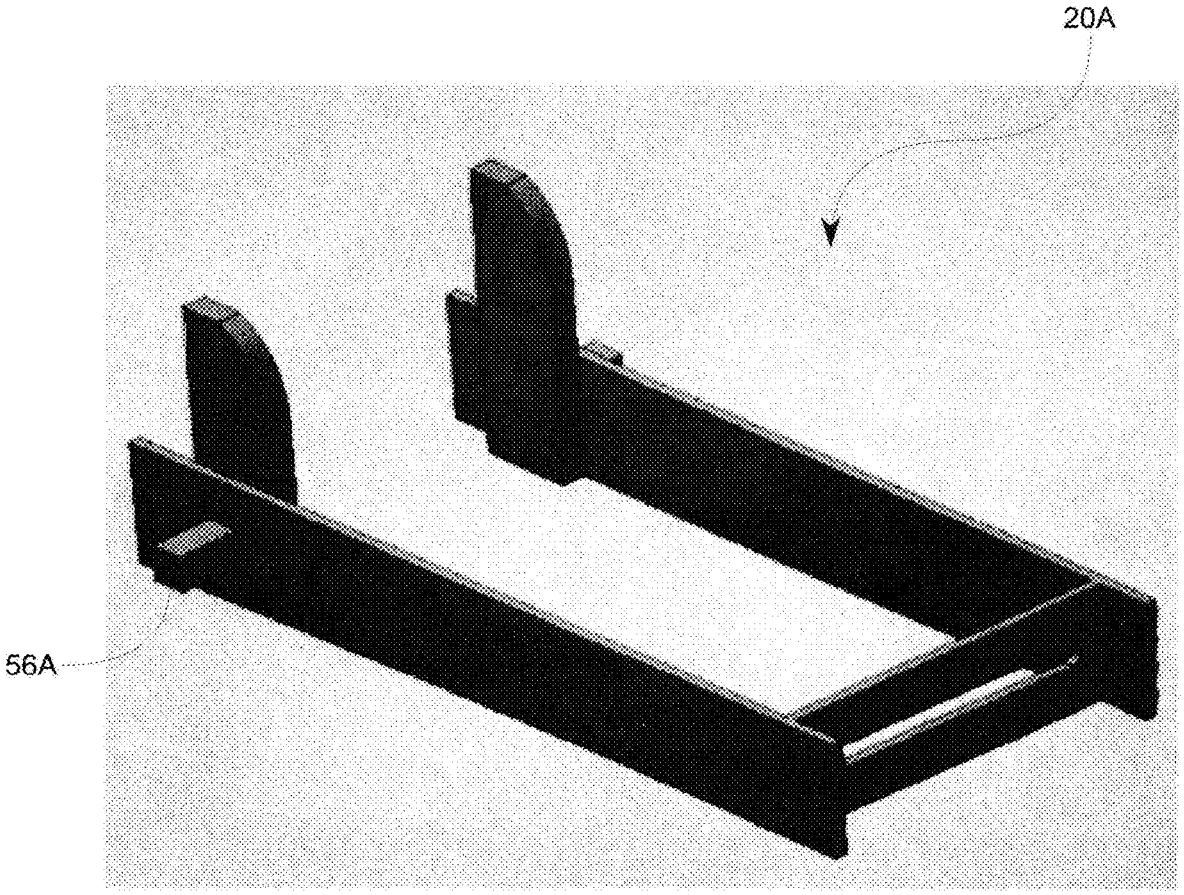
FIG. 14 illustrates a perspective view of an alternative device for aiding in the stringing musical instruments.

FIG. 14 illustrates an exemplary solid model of an alternative device for aiding in the stringing of musical instruments 20A which includes an alternative attachment interface 56A wherein the pegs forming the attachment interface 56A are instead formed having a square or rectangular cross-section so as to aid in the fabrication process, particularly in additive material fabrication. In such an embodiment the pegs can be press fit into corresponding apertures in the side support members. This configuration also aids in prevention of any unwanted pivoting of the side support members with respect to the attachment interface while installed on the neck of the instrument on which the device is mounted.

Those skilled in the art will recognize improvements and modifications to the preferred embodiments of the present disclosure. All such improvements and modifications are considered within the scope of the concepts disclosed herein and the claims that follow. Additionally, any steps or processes discussed herein are not intended to be restrictive with regard to a particular sequence and those having skill in the art will recognize where certain steps may be performed in various alternative sequences. Further, as will be recognized by those having skill in the art, any features as discussed with any particular element with regard to a particular embodiment may be similarly applied to alternative elements in alternative embodiments wherever appropriate.

I claim:

1. An apparatus for aiding in mounting strings to an instrument, the apparatus comprising:

a frame, the frame further comprising:
- a pair of opposing extension members;
- a cross-member connecting the opposing extension members at a distal end;
- a support member extending laterally from each of the opposing extension members;

a retention assembly, the retention assembly further comprising:
- an attachment interface; and
- an attachment member;
- wherein the retention assembly is configured to retain a proximal end of the opposing extension members and each support member against a neck portion of a musical instrument;

a tensile retaining mechanism, being supported about the cross-member and extending toward the neck portion of the musical instrument, the tensile retaining mechanism including clip member;

wherein the clip member of the tensile retaining mechanism is configured to receive a string for mounting to the instrument, the tensile retaining mechanism configured to maintain a desired lateral position along the neck portion and maintain a tensile force to the string during a tightening process.

* * * * *